US005657639A

United States Patent [19]

Lidbeck

[11] Patent Number: 5,657,639

[45] Date of Patent: Aug. 19, 1997

[54] CONVECTION REFRIGERATION PROCESS AND APPARATUS

[76] Inventor: Ulf Lidbeck, 27 Longboat Dr., Centerville, Mass. 02632

[21] Appl. No.: 489,796

[22] Filed: Jun. 13, 1995

Related U.S. Application Data

[63] Continuation-in-part of Ser. No. 113,682, Aug. 28, 1993, abandoned.

[51] Int. Cl.[6] ..... F25D 17/08

[52] U.S. Cl. ..... 62/186; 62/265; 62/382; 62/282; 62/408; 62/441

[58] Field of Search ..... 62/282, 131, 189, 62/265, 267, 266, 186, 187, 382, 419, 408, 441, 442

[56] References Cited

U.S. PATENT DOCUMENTS

| | | | |
|---|---|---|---|
| 2,145,892 | 2/1939 | Roberts | 62/408 X |
| 2,312,325 | 3/1943 | Earle | 62/382 X |
| 2,450,844 | 10/1948 | Stuart | 62/441 X |
| 2,455,182 | 11/1948 | La Vallee | 62/131 |
| 2,480,339 | 8/1949 | Rifkin | 62/189 X |
| 2,929,228 | 3/1960 | Gould, Jr. | 62/382 |
| 3,115,017 | 12/1963 | Kocher et al. | 62/265 X |
| 3,364,694 | 1/1968 | Cohen et al. | 62/408 |
| 3,477,243 | 11/1969 | Schroeder et al. | 62/408 |
| 4,662,186 | 5/1987 | Park | 62/408 X |
| 5,111,664 | 5/1992 | Yang | 62/408 X |

*Primary Examiner*—Harry B. Tanner
*Attorney, Agent, or Firm*—Duane, Morris & Heckscher

[57] ABSTRACT

The present invention provides a refrigeration process and apparatus which includes refrigeration means detachably connected by conduits, preferably insulated, to a series of individually refrigerated compartments, preferably drawer units, having evacuation conduits also detachably connected to the drawer units to direct circulating cold air flow through each individual drawer without a vast unrestricted flow of cold air throughout a refrigerator housing.

9 Claims, 4 Drawing Sheets

CONVECTION REFRIGERATION PROCESS AND APPARATUS

RELATED APPLICATION

This application is a continuation-in-part of application Ser. No. 08/113,682 filed on Aug. 28, 1993 now abandoned.

FIELD OF INVENTION

The present invention relates to refrigeration apparatus, and in particular to refrigeratable compartments by convection/recirculating refrigerated air flow and especially to a chest of insulated drawers refrigerated by convection/circulated chilled air flow. The invention also relates to a refrigeration process utilizing such apparatus.

BACKGROUND OF THE INVENTION

The present inventive convection refrigeration process and apparatus provides for a vast improvement over existing refrigeration processes and devices which employ a refrigeration unit releasing unrestricted cold air flow to common areas of a refrigerated compartment, and/or to areas of a device which do not require refrigeration. For example, in many of the common household refrigerators using a single large food storage compartment having nominally segmented areas, for example, by sliding shelves etc., various areas are exposed to room temperature air when the refrigerator door is opened, thus immediately decreasing the temperature of such areas. The temperature of compartments which are only nominally segmented from common areas by sliding plastic or glass shelves and the like, and are typically not air tight, is also lowered by exposure to room temperature air. Such conventional refrigerators are thus very inefficient as large amounts of energy are expended to attain the desired cooling temperature upon shutting a main door common to all refrigerated areas. Maintenance of different temperatures in different refrigerated compartments is also typically not possible.

An improvement upon the standard refrigerator is disclosed in U.S. Pat. No. 4,662,186 to Park. In this reference, a refrigeration apparatus is discussed which comprises a housing having a food storage compartment with a food storage drawer slidably disposed in the food storage compartment. The apparatus also utilizes an air delivery duct for directing a stream of chilled air to the food storage compartment which also includes a chilled air delivery vent in the drawer and a return air duct for returning air from the food storage compartment in a return vent opening in the compartment to a chilled air generating means. Also included is a means for automatically blocking the flow of air through the delivery vent opening and return vent opening when the drawer is in an open position, and for automatically unblocking the flow of air through the delivery vent opening and the return vent opening when the drawer is in a closed position. The vent blocking is performed by a system of dampers operated by push rods mounted on the drawer, such that when the drawer is closed, a damper moves an air vent to an open position, and when the drawer is opened, the damper moves an air vent to a closed position. Separate sets of dampers are used for both chilled air delivery vents and return air vents.

The Park refrigerator, however, is inefficient in that chilled air from a chilled air generating means is not channeled to a specific area to maintain a desired temperature in a compartment and then returned for further cooling, but instead provides for the unrestricted flow of air throughout a housing which enters one or more drawers through the aforesaid vents, thus providing for an inefficient waste of cooling energy on areas which do not have to be chilled or maintained at a desired temperature. The mechanical venting systems of Park are also inefficient in that they are always intermittently exposed to chilled air flow and room temperature air upon opening and closing the door to the food storage compartment, and thus are prone to changes in humidity and are likely to accumulate condensate and freeze up thereby not properly closing and/or opening, thus requiring constant attention. Additionally, the Park refrigerator does not provide means for removal of water or condensate from a refrigerated compartment, nor can the Park refrigeration apparatus be defrosted without affecting the temperature in a refrigerated compartment.

SUMMARY OF THE INVENTION

The present inventive refrigeration process and apparatus is a vast improvement over such conventional systems, in that refrigeration means is employed which is detachably connected by conduits, preferably insulated, to a series of individually refrigerated compartments, preferably drawer units, having evacuation conduits also detachably connected to the drawer units to direct circulating cold air flow through each individual drawer without a vast unrestricted flow of cold air throughout a refrigerator housing. Problem proned exposed push rod operated vents, damper systems and other exposed mechanical venting systems are also avoided.

This invention also provides for selective temperature control via convection circulating chilled air flow in one or more refrigeratable compartments, for example, drawer means, slidably positioned in a housing, distinct and separate from other refrigerated drawers, and which when opened to room temperature air, such circulating air flow is automatically cut off by electronically actuated means, preferably insulated from the chilled air environment, such that opening one drawer to a room temperature environment will not affect the temperature maintenance in any other drawer.

In another aspect of this invention there is provided a defrosting means, wherein selected refrigerated compartments and a refrigeration generation means i.e., a means for generating a flow of chilled air, can be defrosted without affecting temperature maintenance in one or more refrigerated compartments, e.g., drawers mounted in a common housing.

Thus, in its broadest sense, there is provided by the present invention, a refrigeration apparatus comprising a housing means enclosing at least one refrigeratable compartment means, and a means for generating a flow of chilled air; a first manifold means for receiving the flow of chilled air from the chilled air generating means; first conduit means for directing a portion of the chilled air from the first manifold means to one or more refrigeratable compartments; and a second manifold means for receiving air from a second conduit means for returning air in one or more refrigeratable compartments to the chilled air generating means; and wherein at least one of said refrigeratable compartment means is a slidably mounted in said housing means, and effective to provide for slidable movement in the housing means from a closed position in which all of said compartment is wholly enclosed by said housing means to an open position in which at least a portion of said compartment is not enclosed by said housing means; and wherein the first conduit means is equipped with electronically actuated first valve means effective to cut-off or restrict to a portion thereof chilled air flow from the first manifold means when the compartment is in an open position. The second conduit means is also equipped with an electronically actuated second valve means effective to cut off or restrict to a portion thereof air from a compartment to said second manifold means when the compartment is an open position, and wherein the first and second electronically actuated valve means are also effective to restore, or at least partially restore, circulating air flow through the first and second conduit means where the compartment is in a closed, or partially closed, position.

In another aspect of the invention, there is provided a refrigeratable apparatus such as set forth above, in which is provided a pressure sensitive overflow valve means for receiving backed-up cooling air from the first conduit means, and conduit means for channeling such backed up air through a thermostatically controlled cooling means which is thermostatically activatable to generate or cease generating chilled air, and maintain a reservoir supply of chilled air accordingly.

In a further aspect of this invention there is provided a refrigeratable apparatus such as discussed above, with means for conducting the apparatus in a defroster mode while not affecting to any appreciable degree the desired temperature in one or more refrigerated compartments, for example, in one or more refrigerated drawers.

These and other aspects and advantages of the process and apparatus of this invention will be better understood by reference to the following detailed description of preferred embodiments, and the attached Figures which illustrate and exemplify such embodiments. It is to be understood, however, that such illustrated embodiments are not intended to restrict the present invention, since many more modifications may be made within the scope of the claims without departing from the spirit thereof.

BRIEF DESCRIPTION OF THE DRAWINGS

FIGS. 4*a* and 4*b* illustrate a schematic frontal plan view of the valve of FIGS. 4*a*–4*f*.

FIGS. 4*c*–4*f* illustrate partial cut-away perspective views of the valve of FIGS. 4*a*–4*f*.

DETAILED DESCRIPTION OF PREFERRED EMBODIMENTS

Figure 1:
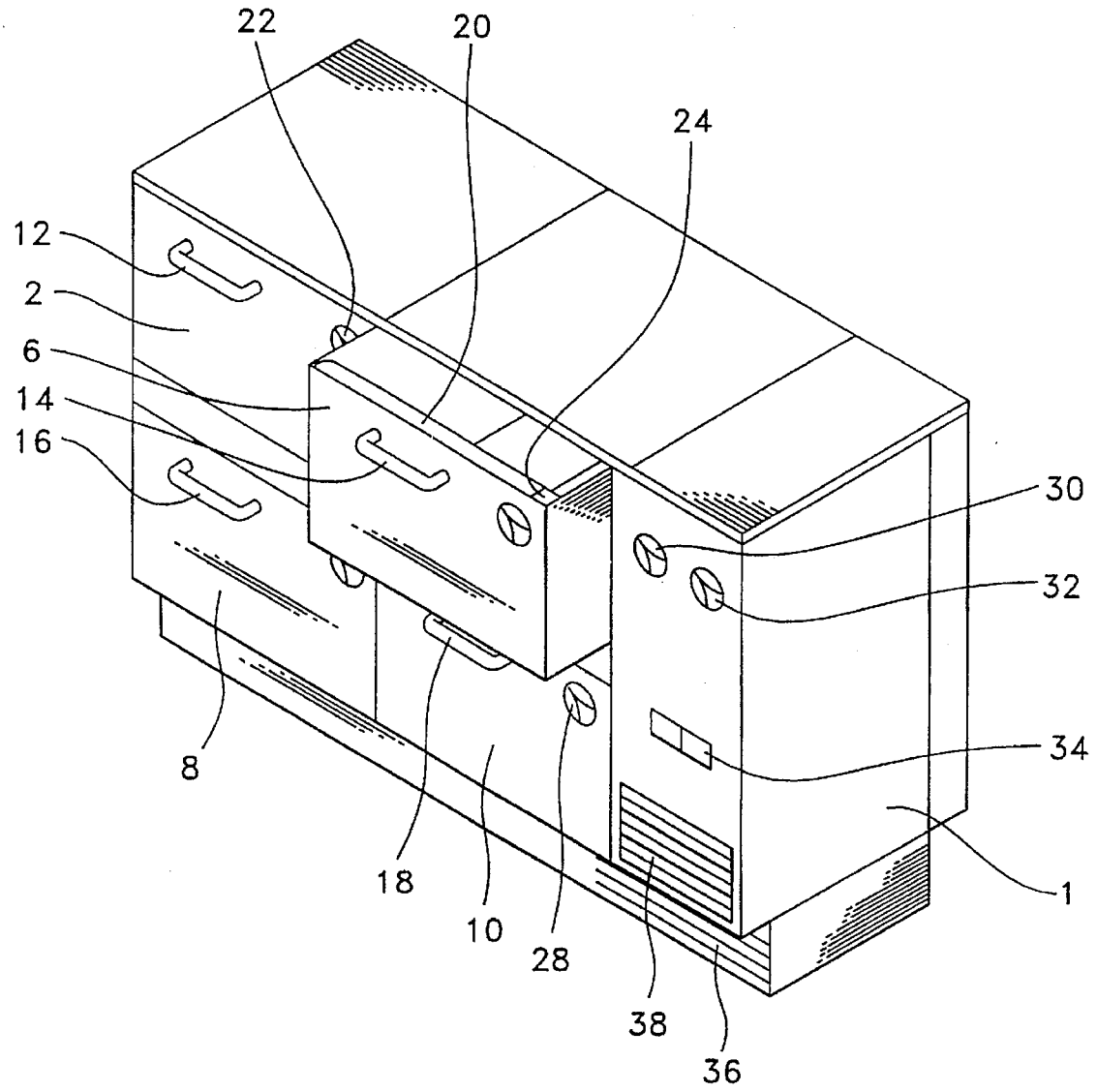
FIG. 1 is a frontal perspective view of a preferred embodiment of a refrigeration apparatus in accordance with this invention.

FIG. 1 illustrates a perspective view of a convection refrigeration apparatus in accordance with a preferred embodiment of this invention. As indicated generally by 1 a (refrigeration) housing means 1 encloses a plurality of refrigeratable compartments, which in this embodiment are refrigeratable drawer means, shown generally as 2, 6, 8 and 10. Each of the drawer means have front, sides and bottom portions, and at least a partially open top portion, and are slidably opened and closed in housing 1 on respective track means (not shown) attached to the infrastructure of housing means 1, denoted generally as infrastructure housing means 1*a*, by handle means 12, 14, 16, 18, respectively, to form a refrigeratable chest of drawer means. Each drawer means is preferably insulated, and when in a closed position in housing means 1 is preferably hermetically sealable from the environment and other drawer means and components situated in housing infrastructure means 1*a*, as discussed below. Drawer means 6 is shown in an open position with drawer cold air supply duct means indicated by 20. Manual drawer valve means 22, 24 and 28 are provided for each of drawer means 2, 6, 8 and 10, respectively. Individual drawer valve means for drawer means 8 is not shown as it is blocked from view by a portion of open drawer means 6. Also situated on housing unit 1 is a rheostat means 30 for manual regulation of circulating air velocity, and a thermostat means 32 for manual temperature control of circulating air within the drawer means. A defroster switch means is indicated by 34. An air intake means 36 is provided in housing means 1 to supply a cooling compressor means 84 (not shown in FIG. 1, see FIG. 2), and an air outlet means 38 is also provided in housing means 1 for exhaust air from the cooling compressor means 84.

Figure 2:
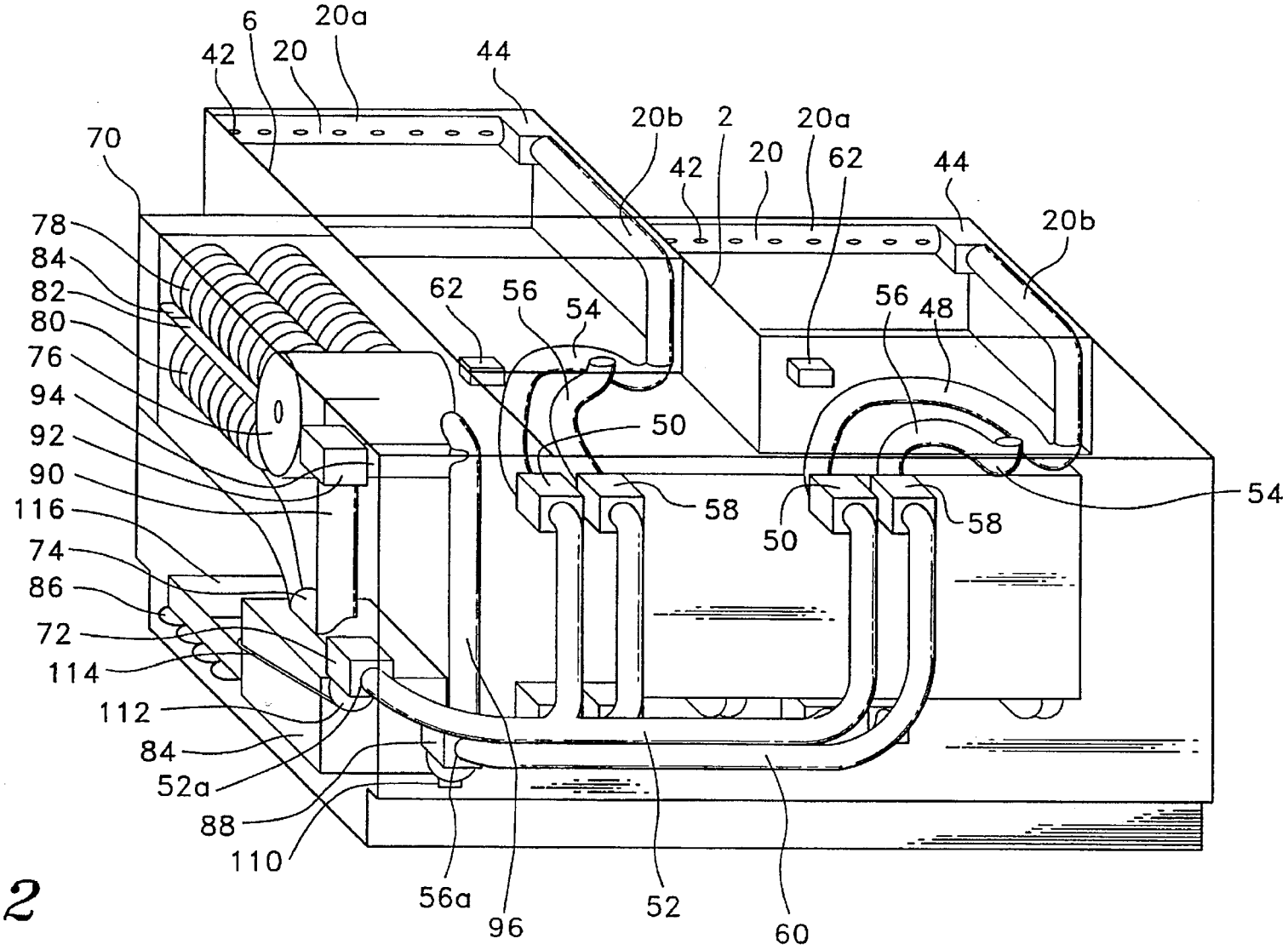
FIG. 2 is a rear cut-away perspective view of the preferred embodiment of refrigeration apparatus shown in FIG. 1.

In FIG. 2, there is shown a cut-away rear perspective view of the convection refrigeration apparatus of FIG. 1. A rear view has been selected to better illustrate each of the internal components situated in housing means 1, generally behind drawer means 2, 6, 8 and 10, and the general infrastructure and workings of each of the components in this preferred example.

Turning now to housing means 1, the inside of each of drawer means 2 and 6 are illustrated in cutaway views with only the rear of each of drawer means 8 and 10 being shown. Drawer means 6 is shown in an open position, and slidably situated in its respective track means which itself is anchored in the infrastructure means 1*a* of housing means 1. Drawer means 2 is shown in a closed position, and is also slidably situated in its respective track means which is integral with and forms a portion of the inside infrastructure means 1*a* of housing means 1. Housing infrastructure means 1*a*, also supports other components to be discussed below.

In this preferred example, in each of drawer means 2 and 6 is situated a cold air supply duct means 20 on the upper inside portion of a drawer front portion. This being only a preferred embodiment, however, it is contemplated that a cold air supply duct means can be situated wherever desired in a refrigeratable compartment in accordance with this invention. As also shown in this preferred example, each cold air supply duct means 20 is in the form of a conduit which is perforated by a multiplicity of cold air supply inlets, referred to herein as cold nostril means 42, and which are situated along a portion of cold air supply duct means 20. Preferably, said nostril means 42 are equally spaced from one another and are situated essentially along the entire length of cold air supply duct means 20, which in combination with nostril means 42 forms a cold air distributer means 20*a* in each respective drawer. Each of said cold air nostril means 42 in cold air distributor means 20*a* faces in a substantially horizontal position toward the inside of each drawer means. It is contemplated however, that each nostril means 42 is adjustable to feed cold air to a drawer means at various oblique angles relative to the bottom of a drawer means.

Each cold air distributor means 20*a* in each drawer means, as shown in this preferred embodiment, is detachably connected to a manual drawer valve means 44 for manual regulation of a drawer's cold air supply for individual temperature adjustment inside each drawer means. Although not shown, a temperature indicator may also be provided in or on the front outside portion of one or more drawer means. Each drawer valve means 44 is in turn in detachable cold air flow communication with one end of a non-perforated portion of cold air supply duct means 20, indicated as 20*b*, and as shown in this preferred embodiment, is attached to and runs along a side wall portion of a drawer means, and at a bottom portion of a drawer means terminates at its other end in detachable flow communication with cold air supply conduit means 48. In this example, conduit means 48 is of a flexi-hose construction type, which is movable with the slidable movement of the opening and closing of a drawer means.

Each cold air supply conduit means 48 is in flow communication with a solenoid-actuated cold air valve means 50 situated in housing infrastructure means 1*a*, and said valve means 50 is in flow communication with cold air distributor duct means 52.

Also situated in each drawer means is an evacuation port means 54 which is in flow communication with an evacuation conduit means 56. In this example, evacuation conduit means 56 is also of a flexi-hose construction in the same manner as cold air supply conduit means 48, and is also designed to move with the slidable opening and closing movement of a drawer means. Evacuation conduit means 56 is in flow communication with a solenoid-actuated evacuation valve means 58 situated in housing infrastructure means 1*a*, and said evacuation valve means 58 is itself in flow communication with main collector manifold means 60.

Preferably, each of conduit means 48 and 56 are insulated, and can be of any construction such as steel or stainless steel flexi-hose, or may be of simple plastic hose construction or of some suitable flexible hose construction. It is also contemplated that conduit means 48 and 56 be in the form of telescoping conduits which extend and retract with slidable drawer movement and which are also are provided or otherwise encapsulated with a suitable insulation means. It is also preferred that each of valve means 50 and 58 be insulated or are provided or encapsulated with insulation means, so as to not be affected by temperature and humidity conditions.

Thus, as indicated in this preferred embodiment, two manifold means, main cold air distributor duct means 52 and main collector manifold means 60, respectively, are in flow communication with respective solenoid-actuated valves, cold air valve means 50 and evacuation valve means 58, which are in respective flow communication with a cold air supply conduit means 48 and evacuation conduit means 56, which in turn are in respective flow communication with a cold air supply duct means 20 and cold air distributor means 20*a* and an evacuation port means 54 in each respective drawer means 2, 6, 8 and 10.

A switch means 62 situated on housing infrastructure means 1*a*, is electronically actuated upon opening, or at least partially opening, each drawer means. When actuated, for example, upon opening a drawer means 2, 6, 8 and/or 10, or partially opening as the case may be, switch means 62 will close, or partially close, as desired, solenoid controlled cold air valve means 50 thereby cutting off (or at least partially cutting off) the supply of cold air to cold air supply duct means 20, and thus the supply of cold air to a respective drawer means or at least restrict the supply as desired. Thus, when a drawer means is opened, or partially opened as desired, the flow of cold air to the respective drawer means will be automatically cut off or at least reduced to a desired degree by electronically actuated switch means 62 which actuates a solenoid-actuated cold air valve means 20.

Further, upon opening one or more respective drawer means 2, 6, 8 and/or 10 (or at least partially opening a drawer means) a respective switch means 62 also closes (or at least partially closes), solenoid-controlled respective evacuation valve means 58 to stop or restrict to a desired degree air flow from evacuation conduit means 56 and its respective drawer means to the main collector manifold means 60.

Correspondingly, upon closing (or at least partially closing) one or more drawer means, respective switch means 62 will electronically actuate respective solenoid-actuated cold air valve means 50 to open and evacuation valve means 58 will also open once again restoring cold air flow circulation through one or more respective closed drawer means via main cold air distributor duct means 52 and main collector manifold means 60.

Cold air is initially manufactured and supplied to cold air distributor duct means 52 by a refrigeration generation means, shown generally as 70, as explained in detail below.

Specifically, as shown in this preferred embodiment, the inlet 52*a* of cold air distributor duct means 52 is in detachable flow communication with a solenoid-controlled valve means for defroster air outlet (defroster air outlet valve means) 72 which regulates cold air from cold air supply duct 74. The cold air supply duct 74 is in flow communication with upper and lower cooling coil means 78 and 80, respectively, which are separated by sheet 82, which is effective to force air to pass through all of coils 78 prior to passing through all of coils 80, which manufacture cold air via compressor means 84 and condenser means 86. Cold air is forced by a blower means 76, preferably of a multispeed variety, from upper coils 79 through coil inlet 84*a* to lower coils 80, and then in turn through supply duct 74, defroster air outlet valve 72, inlet 52*a* and into cold air distributor duct means 52 for distribution through drawer means as set forth above.

While cold air is being distributed through the drawer means in the manner set forth above, cold air is circulated through the closed (or at least partially closed) drawer means and cold air and condensate (water) are evacuated from the drawer means back to the refrigeration unit where it is refrigerated and recirculated as set forth below. Specifically, evacuated cold air and condensate leaving a drawer means through evacuation conduit means 56 as described above, passes through evacuation inlet 56*a* at a terminus of main collector manifold means 60 and then through a solenoid valve means for defroster air intake (defroster air inlet valve means) 88 and thereafter through air return duct 96 into cooling coil means 78 and 80 via blower means 76. Rheostat means (FIG. 1) 30 regulates the speed of blower means 76 to regulate circulating air velocity throughout the system and in each drawer means.

When, for example, several drawer means are open simultaneously, and circulating cold air is automatically shut off in the manner described above, the air flow through the cold air distributor duct means 52, and also ducts 90 and 74, may become backed up and air flow in main collection manifold means 60 and in air return duct 96 become "strangled", at which point the blower means 76 will create an over-pressure in cold air supply duct 74 and in a lower over flow duct means 90. An under-pressure is also created in means 60 and 96. When this occurs, at a predetermined over-pressure, an overflow valve means 92 will open allowing backed up refrigerated air to flow through lower overflow duct means 90, and thereafter through upper overflow duct means 94, and in turn through air return duct 96, leading the air back to cooling coil means 78 and 80, where a thermostat means (not shown) will automatically stop the compressor means 84 and blower means 76 from providing additional cold air to cold air supply duct 74.

Figure 3A:
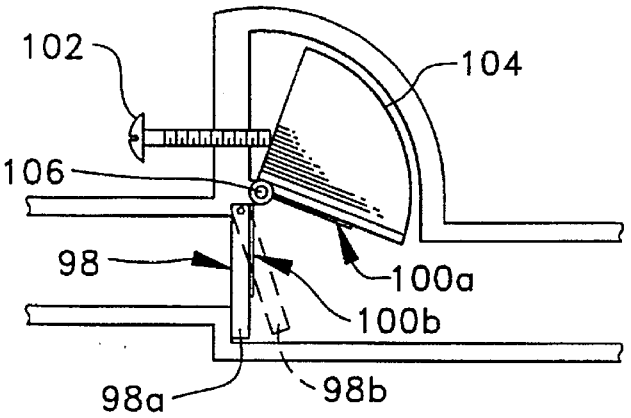
FIGS. 3*a*, 3*b*, are perspective illustrations of a preferred construction and portions thereof of an overflow valve means for use with the refrigeration apparatus of this invention.
Figure 3B:
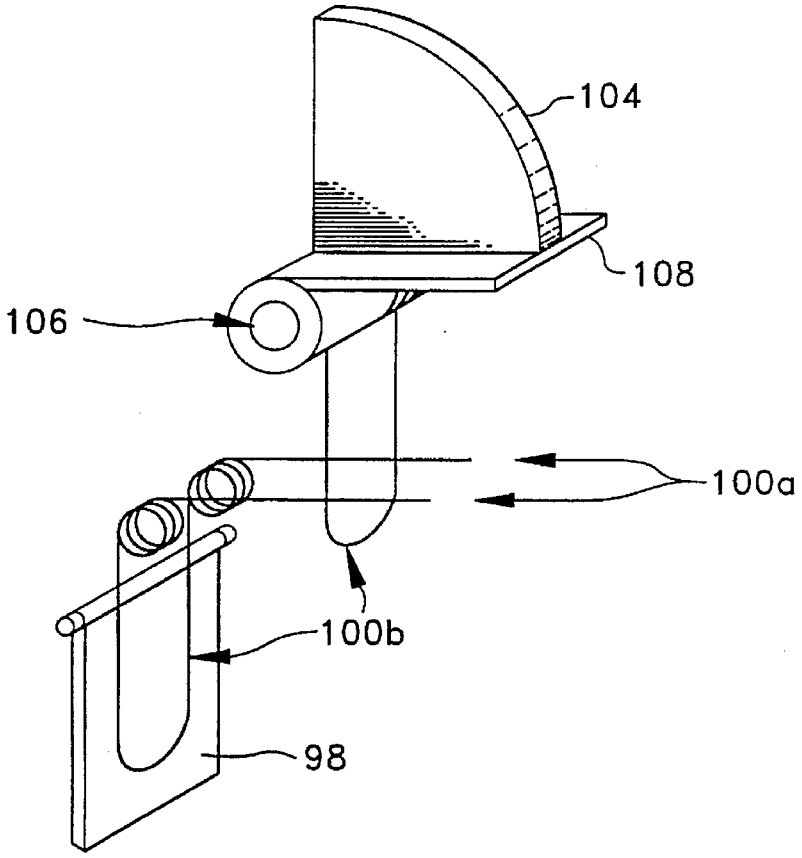

In another aspect of this invention, there is illustrated in FIG. 3*a* a preferred construction of an overflow valve means 92. Referring now to FIG. 3*a*, when air pressure in lower overflow duct 90 reaches a predetermined level, an overflow lid 98 will move from a closed position 98*a* to an open position 98*b*, thereby letting an over pressure of air pass through upper overflow duct means 94. Prior to reaching the predetermined pressure, overflow lid 98 is maintained in a closed position by spring means 100, with spring means 100*a* indicating an open position and 100*b* indicating a closed position. The tension of spring means 100 can be set to various desired levels by an overflow screw means 102 exerting a pressure against regulator wing 104, which is in pivotal attachment to shaft 106. As shown in FIG. 3*b*, when regulator wing 104 pivots downward around shaft 106, it will move a spring tensioning means 108, shown in this preferred embodiment as a flat planer surface molded to the bottom of regulating wing 104, to increase the tension of and thus tighten spring means 100. As also shown in FIG. 3*b* spring means 100 at a certain pressure snaps from a closed position 100*b* in which it is adjacent to and keeps closed overflow lid 98 (98*a* in FIG. 3*a*) to an open position 100*a* and in which the overflow lid 98 is opened (98*b* in FIG. 3*a*).

In another aspect, the present invention also provides for a defroster mode while maintaining (or at least substantially maintaining) the temperature in refrigerated drawer means. In particular, referring once again to FIGS. 1 and 2, upon activation of defroster switch 34 (FIG. 1), solenoid valve means 88 and 72 are actuated to close and block circulating air from blower means 76 to the drawer means and back, as detailed above. At the same time that the defroster switch 34 is actuated, defroster intake 110 and a defroster outlet 112 are opened by solenoid valve means 88 and 72, respectively, to allow room temperature air forced by the blower 76 to flush through cooling coils 79 and 80 at a high velocity with the effect of melting any frozen condensate accumulated on coils 79 and 80, and to also blow air and any accumulated water out through defroster outlet 112 thereafter allowing any melted frozen condensate (i.e., accumulated water) to flow through a draining pipe 114 to vaporizing pan 116, which is located over condenser 86 and is thereby heated and vaporized by condenser means 86. Thus, as shown, coupling of solenoid defroster valve means 88 and 72 enables defrosting of cooling coils 78 and 80 while circulation of air through the drawer means is stopped, thereby permitting defrosting of coils 78 and 80 while not affecting to any significant degree the temperature in the refrigerated drawer means.

In accordance with this invention and its attendant advantages, fast and highly efficient defrosting is achieved by using blower means 76 to create a "reverse wind chill" factor, with condensate melting at an increased rate when exposed to an increased rate of warmer air.

In another aspect of this invention one or more drawer means is provided with a manual valve means, shown as 22, 24, 26 (not shown), and 28 in FIG. 1 now referred to generally as 44, to further regulate the flow of refrigerated air through a respective drawer means, thereby regulating and maintaining a specific desired temperature in one or more drawer means. As shown in FIG. 2, the manual valve means 44 is located at a terminus of the non-perforated portion of cold air distributor means 20*b*, and which connects said terminus to perforated cold air supply duct means 20*a*.

Figure 4A:
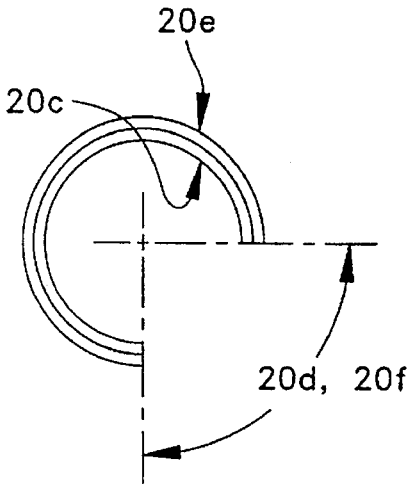
FIGS. 4*a*–4*f* illustrate a preferred construction of a manual drawer valve for use with the refrigeration apparatus of this invention.
Figure 4B:
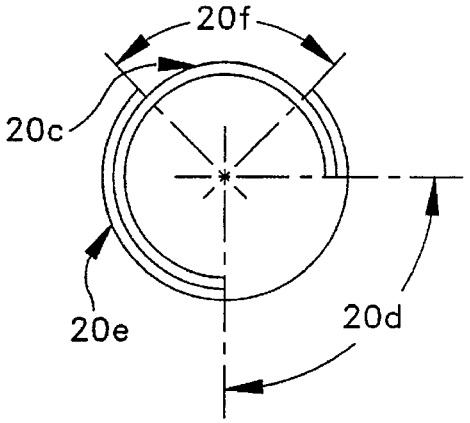

A preferred construction of manual valve means 44 is shown in FIGS. 4*a*–4*f*. In FIGS. 4*a*and 4*b*, the terminus portion of cold air supply duct means 20*b* is indicated as 20*c*, with an open portion 20*d*. The terminus 20*c* of supply duct 20*b* is covered with a rotatable coaxial outer portion 20*e*, which itself has an open portion 20*f*, and a handle 119 (See FIGS. 4*a* and 4*f*) for rotating portion 20*e* coaxially about portion 20*c*. As shown in FIG. 4*a*, outer portion 20*e* can be coaxially rotated about portion 20*c* such that openings 20*d* and 20*f* coincide to form a common opening of various sizes, depending upon the degree of coaxial rotation of portion 20*e* relative to that of portion 20*c*, thereby allowing various quantities of cold air from cold air supply duct means 20*b* to pass into a drawer means.

Figure 4C:
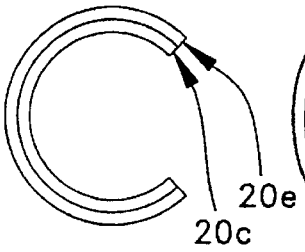
Figure 4D:
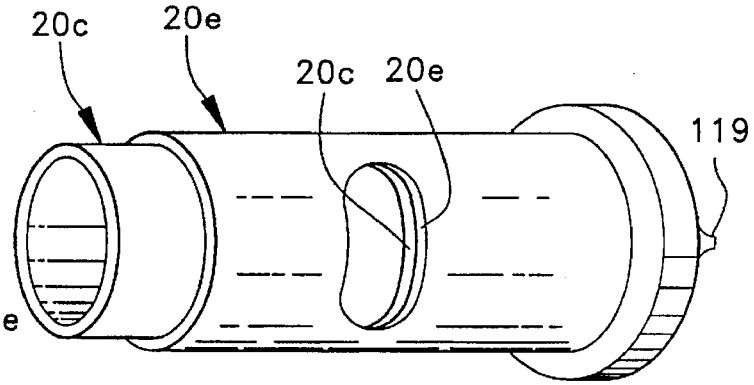
Figure 4E:
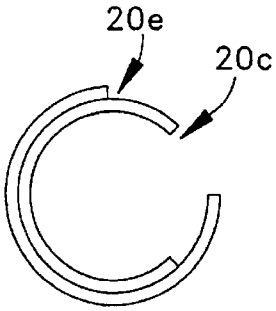
Figure 4F:
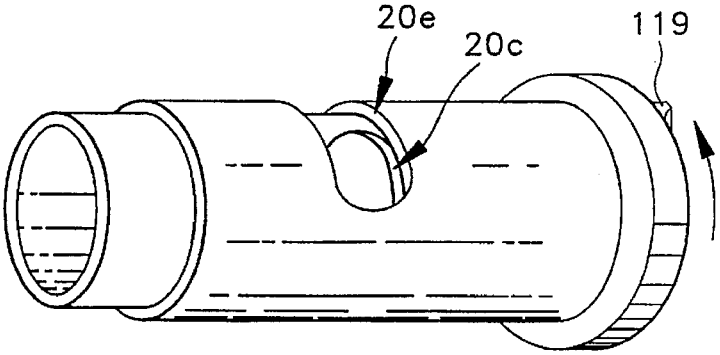

FIGS. 4*c* and 4*f* show plan and perspective views of coaxial portions 20*c* and 20*e* coaxially rotated to form completely coincided openings 20*d* and 20*f* (FIG. 4*c*) and partially coincided openings 20*d* and 20*f* (FIG. 4*e* ), upon coaxial rotation of 20*e* about 20*c* by handle 119.

The temperature of circulating air throughout the drawer means and respective manifolds is regulated by the thermostat means 32. The velocity of the circulating air is regulated by blower means 76 via rheostat 30 to increase (or decrease as desired) circulating air velocity, and to create a "wind chill" affect for rapid freezing of articles contained in a drawer means, and to also provide for rapid defrosting of the refrigeration cooling coils means 78 and 80.

In similar manner to conduit means 48 and 56, it is also preferred that each of manifold means 52 and 60, defroster air inlet valve means 88, over flow valve means 92, lower over-flow duct means 90, upper overflow duct means 94, air return duct 96, and all other duct and valve means as the case may be, are provided with suitable insulation. Further, although not shown, the refrigeration generation means 70 inclusive of cooling coils 78 and 80 and cold air duct 74 are preferable enclosed in an insulated compartment.

It is contemplated that the process and apparatus of this invention is useful in any conventional or unconventional refrigeration application such as food storage in either domestic or commercial environments, in hospital and research facilities for cold storage of various material and in mortuaries.

I claim:

1. Refrigeration apparatus comprising a housing means enclosing at least one refrigeratable compartment means, and a means for generating a flow of chilled air;

a first manifold means for receiving the flow of chilled air from the chilled air generating means;

a first conduit means for directing a portion of the chilled air from the first manifold means to one or more refrigeratable compartments;

a second conduit means for receiving air in one or more refrigeratable compartments; and a second manifold means for receiving the flow of air from the second conduit means and for returning air to the chilled air generating means, and wherein one or more of said refrigeratable compartments is slidably mounted in said housing means, and effective to provide for slidable movement in the housing means from a closed position in which all of said compartment is enclosed by said housing means to an open position in which at least a portion of said compartment is not enclosed by said housing means; and wherein said first conduit means is equipped with a first electronically actuated valve means effective to cut-off or restrict to a portion thereof chilled air flow from the first manifold means, and said second conduit means is equipped with a second electronically actuated valve means to cut-off or restrict to a portion thereof air flow from the compartment to the second manifold means, when the compartment is in an open or partially open position; and wherein said first and second electronically actuated valve means are effective to restore or at least restore a portion thereof chilled air flow to the compartment from the first manifold means and air flow from the compartment to the second manifold means when the compartment is in a closed or partially closed position.

2. The refrigeration apparatus of claim 1 wherein the refrigeratable compartment means are insulated drawer means having four side portions and a bottom portion, and wherein said drawer means are hermetically sealable in a closed position in said housing means.

3. The refrigeration apparatus of claim 1 in which said first and second conduit means are of flexible hose construction and are able to conform to slidable opening and closing movement of said slidable compartments in said housing means.

4. The refrigeration apparatus of claim 2 in which the first and second conduit means are of flexible hose construction and are able to conform to slidable opening and closing movement of said slidable drawer means in said housing means.

5. The refrigeration apparatus of claim 4 in which said first and second conduit means, said first and second electronically actuated valve means, said first and second manifold means and said chilled air generation means are insulated or are provided with effective insulation from environmental contact.

6. The refrigeration apparatus of claim 5 wherein one or more drawer means are provided with a manual valve means effective for regulation of chilled air into said draw from said first conduit means.

7. The refrigeration apparatus of claim 6 wherein said manual valve means comprises a cold air supply duct means which is covered with a coaxial rotatable outer portion, and wherein each of said cold air supply duct means and coaxial rotatable outer portion have open portions which when said coaxial rotatable outer portion is coaxially rotated about cold air supply duct means at a common point coincide to an extent to form a common opening, to thereby effect the degree of cold air supply.

8. The refrigeration apparatus of claim 1 further comprising defrosting means comprising third and fourth electronically actuated valve means, wherein said actuated said valve means are effective to block air from returning to said chilled air flow generating means from said second manifold means and to block chilled air from entering said first manifold means, respectively, and which further comprises an air intake means and air outlet means which are opened by said third and fourth electronically actuated valve means respectively wherein air through said air intake means is introduced through said chilled air generating means to remove any accumulated frozen condensate, and wherein air and removed frozen condensate from said chilled air generation means is introduced through said air outlet means to effect defrosting of said chilled air flow generation means.

9. A refrigeration process comprising generating a flow of chilled air in a chilled air generating means situated in a housing means, flowing said chilled air through a first manifold means, and thereafter through a first conduit means into one or more refrigeratable compartment means, and thereafter removing air flow from said compartment means through a second conduit means, and thereafter through a second manifold means, and returning said air flow from said second manifold means to said chilled air generation means, and wherein said refrigeratable compartment means are slidably mounted in said housing means, and affective to provide slidable movement in said housing means from a closed position in which all of said compartment means is enclosed by said housing means to an open position in which at least a portion of said compartment is not enclosed by said housing means, and wherein said first conduit means is equipped with a first electronically actuated valve means effective to cut-off or restrict to a portion thereof chilled air flow from the first manifold means, and said second conduit means is equipped with a second electronically actuated valve means to cut-off or restrict to a portion thereof air flow from the compartment to the second manifold means, when the compartment is in an open or partially open position; and wherein said first and second electronically actuated valve means are effective to restore or at least restore a portion thereof chilled air flow to the compartment from the first manifold means and air flow from the compartment to the second manifold means when the compartment is in a closed or partially closed position.

* * * * *